US008308256B2

(12) United States Patent
Sano

(10) Patent No.: US 8,308,256 B2
(45) Date of Patent: Nov. 13, 2012

(54) LIQUID EJECTING APPARATUS SIMULTANEOUSLY PERFORMING EJECTION OF LIQUID AND DETECTION OF REMAINING LIQUID AMOUNT

(75) Inventor: Tomohiko Sano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 281 days.

(21) Appl. No.: 12/730,626

(22) Filed: Mar. 24, 2010

(65) Prior Publication Data

US 2010/0253722 A1 Oct. 7, 2010

(30) Foreign Application Priority Data

Apr. 3, 2009 (JP) ..... 2009-090778

(51) Int. Cl.
*B41J 29/38* (2006.01)

(52) U.S. Cl. ..... 347/9; 347/10; 347/14

(58) Field of Classification Search ..... 347/5–7, 347/9–10, 14, 19
See application file for complete search history.

(56) References Cited

U.S. PATENT DOCUMENTS 7,137,679 B2 11/2006 Tsukada et al.
7,325,450 B2 * 2/2008 Usui et al. ..... 347/7
7,325,892 B2 * 2/2008 Nishihara ..... 347/7

FOREIGN PATENT DOCUMENTS

JP 3824216 B2 9/2006

* cited by examiner

*Primary Examiner* — Juanita D Jackson
(74) *Attorney, Agent, or Firm* — Global IP Counselors, LLP

(57) ABSTRACT

A liquid ejecting apparatus includes an ejecting unit which repeatedly ejects a liquid every predetermined unit, a first storing unit which stores the liquid to be supplied to the ejecting unit, a second storing unit which stores the liquid to be supplied to the first storing unit, a pump which supplies the liquid from the second storing unit to the first storing unit, and a control unit which performs a first operation and a second operation. The first operation includes an operation of creating the ejection signal and an operation of performing a predetermined unit of a subsequent ejection using the ejecting unit. The second operation includes an operation of supplying the liquid using the pump, an operation of creating a detection signal, and an operation of detecting the liquid of the second storing unit, wherein the control unit performs the second operation while the first operation is performed.

6 Claims, 4 Drawing Sheets

LIQUID EJECTING APPARATUS SIMULTANEOUSLY PERFORMING EJECTION OF LIQUID AND DETECTION OF REMAINING LIQUID AMOUNT

BACKGROUND

1. Technical Field

The present invention relates to a liquid ejecting apparatus.

2. Related Art

There is known a liquid ejecting apparatus which includes an ejecting unit for ejecting a liquid and a liquid storing unit for storing a liquid. As this kind of liquid ejecting apparatus, for example, an ink jet printer (hereinafter, a printer) is known. A printing head (hereinafter, a head) of the printer corresponds to the ejecting unit, and an ink cartridge thereof corresponds to the liquid storing unit.

In the printer, generally, the consumption state of the ink cartridge is detected. The ink consumption state may be detected by using a technology disclosed in Japanese Patent No. 3,824,216.

In order to drive the head, generally, a head waveform (signal) as a voltage waveform for driving the head is required. In addition, in order to detect the ink consumption state of the ink cartridge mounted with a piezoelectric element, an ink detecting waveform (signal) as a voltage waveform for the piezoelectric element is required. As a printer requiring these kinds of waveforms, there is a printer 100 shown in FIG. 1A.

The printer 100 includes a control unit 101, a DAC (Digital Analog Converter) circuit 102, a head driving circuit 103, and an ink detecting circuit 104.

The control unit 101 includes a creating unit 1011 which creates head waveform data and a creating unit 1012 which creates ink detecting waveform data.

The DAC circuit 102 includes a waveform creating circuit 1021. The waveform creating circuit 1021 is a circuit which is able to create both the head waveform and the ink detecting waveform.

In detail, when the waveform creating circuit 1021 receives the head waveform data created by the creating unit 1011, the waveform creating circuit 1021 creates the head waveform on the basis of the data, and outputs the waveform to the head driving circuit 103. The head driving circuit 103 drives the head in accordance with the waveform.

On the other hand, when the waveform creating circuit 1021 receives the ink detecting waveform data created by the creating unit 1012, the waveform creating circuit 1021 creates the ink detecting waveform on the basis of the data, and outputs the waveform to the ink detecting circuit 104. The ink detecting circuit 104 detects the ink consumption state in accordance with the waveform.

The waveform creating circuit 1021 is not able to simultaneously create and output the head waveform and the ink detecting waveform due to the condition of the circuit. For this reason, it is not possible to detect the ink consumption state while the head waveform is output. On the contrary, it is not possible to drive the head while the ink detecting waveform is output. In addition, since the head waveform and the ink detecting waveform are basically different from each other, it is not possible to use them as a common waveform.

In order to determine whether the ink required for a predetermined unit of printing process (for example, one pass printing process) remains, the ink consumption state is detected before the predetermined unit of printing process is started. However, in this case, since the head driving start timing is delayed due to the above-described reasons, there is concern that the time required for the printing process may be extended. In detail, as shown in FIG. 1B, the ink consumption state detecting process is started (at a time point T1) when the precedent pass printing process is completed, and the subsequent pass printing process is started (at a time point T3) after the detecting process is completed (at a time point T2).

In addition, when the ink supply is performed during the predetermined unit of printing process, ink is exhausted during the printing process, and hence there is concern that ink may leak from an ink ejecting port of the head. Particularly, in the case of a so-called large printer, it is thought that such problems more easily occur compared with other types of printers.

The above-described problem may arise in other types of liquid ejecting apparatuses as well as the printer.

SUMMARY

An advantage of some aspects of the invention is that it provides a liquid ejecting apparatus capable of appropriately ejecting a liquid on the basis of the liquid consumption state.

The liquid ejecting apparatus includes a first storing unit. A liquid is supplied from a second storing unit storing the liquid to the first storing unit. The liquid is stored in the first storing unit, and is supplied from the first storing unit to an ejecting unit repeatedly ejecting the liquid every predetermined unit.

In addition, the liquid ejecting apparatus includes a first creating unit creating an ejection signal for ejecting the liquid from the ejecting unit. In addition to the first creating unit, a second creating unit is provided so as to create a detection signal for detecting the liquid of the second storing unit.

The liquid ejecting apparatus includes a control unit which performs a first operation and a second operation. The first operation includes an operation of creating the ejection signal using the first creating unit and an operation of performing a predetermined unit of a subsequent ejection using the ejecting unit. The second operation includes an operation of supplying the liquid using the pump, an operation of creating the detection signal using the second creating unit, and an operation of detecting the liquid of the second storing unit.

The control unit performs the second operation while the first operation is performed.

With the above-described configuration, it is possible to detect the liquid of the second storing unit while the predetermined unit of ejection is performed. At the same time, it is possible to store the liquid required for the subsequent ejection before the predetermined unit of subsequent ejection is started. Accordingly, it is possible to appropriately perform liquid ejection on the basis of the liquid consumption state.

In addition, the above-described first storing unit may be a liquid supply path provided from the second storing unit to the ejecting unit, or may be a member separately provided from the liquid supply path and having a space for storing the liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
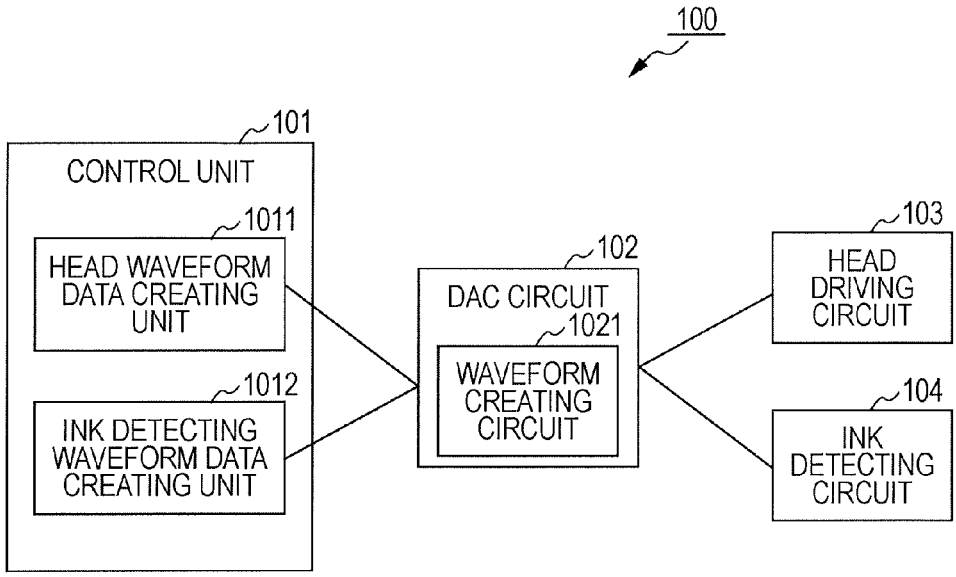
FIG. 1A illustrates a functional block of a printer for generating a head waveform and an ink detecting waveform by using a signal circuit.

Hereinafter, an ink jet printer (hereinafter, a printer) adopting a liquid ejecting apparatus according to an embodiment of the invention will be described by referring to the drawings.

Figure 2:
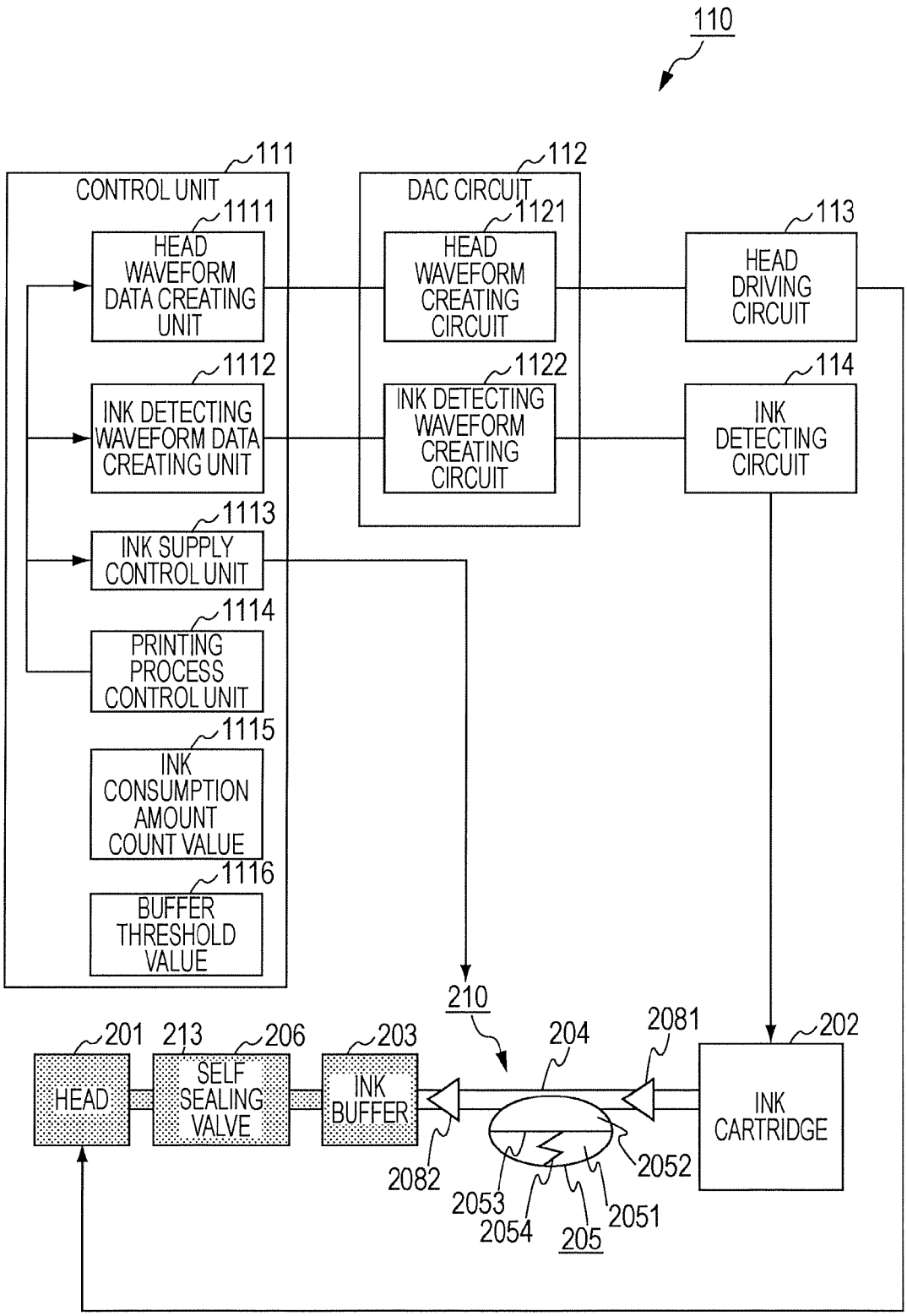
FIG. 2 illustrates a functional block of an ink jet printer adopting a liquid ejecting apparatus according to an embodiment of the invention.

FIG. 2 illustrates a functional block of a printer 110 according to the embodiment of the invention.

The printer 110 includes a DAC (Digital Analog Converter) circuit 112, a head driving circuit 113, a printing head (hereinafter, a head) 201, an ink detecting circuit 114, an ink cartridge 202, an ink buffer 203, an ink supply device 210, and a control unit 111.

The DAC circuit 112 is a circuit which converts a digital signal (data) from the control unit 111 into an analog signal. The DAC circuit 112 is provided with a circuit 1121 which creates a head waveform (signal) as a voltage waveform for driving the head. In addition, in addition to the circuit 1121, a circuit 1122 is provided so as to create an ink detecting waveform (signal) as a voltage waveform for detecting an ink consumption state of the ink cartridge 202.

The head waveform generating circuit 1121 receives the head waveform data from the control unit 111, creates the head waveform on the basis of the data, and then outputs the waveform to the head driving circuit 113. The head driving circuit 103 drives the head 201 in accordance with ejection data representing whether ink is ejected and the head waveform thereof.

The ink detecting waveform generating circuit 1122 receives the ink detecting waveform data from the control unit 111, creates the ink detecting waveform on the basis of the data, and then outputs the waveform to the ink detecting circuit 114. The ink detecting circuit 114 detects an ink consumption state (in other words, the amount of remaining ink) of the ink cartridge 202 in accordance with the waveform.

The circuits 1121 and 1122 may be operated together so as to respectively create predetermined types of waveforms.

The head 201 includes a plurality of nozzles, and is driven by the head driving circuit 113. The head 201 ejects ink droplets from the nozzles on the basis of the supplied ink. The head 201 performs a printing process while traveling from one side to the other side using a carriage (not shown). In the description of the embodiment, the traveling operation of the head 201 from one side to the other side is referred to as a "pass". In addition, the head 201 may be a type of head which does not travel.

The ink supply device 210 is a device used to supply ink stored in the ink cartridge 202 to the head 201. The ink supply device 210 includes, for example, an ink supply path 204 which is provided from the ink cartridge 202 to the head 201, a pump 205 which supplies ink from the ink cartridge 202 to the ink buffer 203, valves 2081 and 2082 which stop the reverse flow of ink, and a self sealing valve 206 which stops the return of ink supplied to the ink buffer 203. A pump 205 is provided between the valve 2081 on the upstream side (on the side of the ink cartridge 202) and the valve 2082 on the downstream side (on the side of the head 201). The self sealing valve 206 is provided on the downstream side of the downstream valve 2082.

The inside of the pump 205 is divided into a first chamber 2051 disposed on the opposite side of the ink supply path 204 and a second chamber 2052 disposed on the side of the ink supply path 204 by an elastic sheet (for example, a rubber film) 2053. In addition, the first chamber 2051 is provided with an urging member (for example, a spring) 2054 urged toward the second chamber 2052.

As operations of the pump 205, there are a suction operation and a discharge operation. In the suction operation, since the inside of the first chamber 2051 is depressurized, ink is sucked from the ink cartridge 202. In the discharge operation, since the depressurization inside the first chamber 2051 is released (open to the atmosphere), ink is discharged to the downstream side due to an urging force of the urging member 2054. The discharged ink is stored in the ink buffer 203.

In addition, the ink supply device 210 is not limited to the above-described device, but may be configured as other types of devices. For example, the ink supply device according to the embodiment of the liquid supply device disclosed in another application (Japanese Patent Application No. 2008-222047 (which is not open at the time of the present application)) of the present applicant may be adopted.

The ink buffer 203 is provided to be closer to the ink cartridge 202 than the self sealing valve 206. The ink buffer 203 is a buffer which stores ink supplied to the head 201. The ink is stored in the ink buffer 203. A total amount of ink in a portion painted in gray in FIG. 2, that is, ink existing inside the head 201, the ink buffer 203, the self sealing valve 206, and the path 213 between the head 201 and the ink buffer 203 is equal to or greater than the amount of ink required in the subsequent pass printing (the printing process in the subsequent one pass). In order to realize this, a volume of the ink buffer 203 or a volume of the path 213 is determined. In addition, instead of the ink buffer 203, a method may be selected in which the path 213 becomes longer. Further, the capacity of the ink buffer 203 is the capacity in which at least a predetermined unit of liquid is ejected.

The control unit 111 may be, for example, a circuit board including a processor or a memory, or a processor. The control unit 111 includes a head waveform data creating unit 1111, an ink detecting waveform data creating unit 1112, an ink supply control unit 1113, and a printing process control unit 1114, and manages an ink consumption amount count value 1115 and a buffer threshold value 1116.

The head waveform data creating unit 1111 creates head waveform data, and transmits the data to the head waveform creating circuit 1121.

The ink detecting waveform data creating unit 1112 creates ink detecting waveform data, and transmits the data to the ink detecting waveform creating circuit 1122.

The ink supply control unit 1113 controls an operation of the ink supply device 210, for example, an operation of the pump 205.

The printing process control unit 1114 controls operations of the creating units 1111 and 1112 and the ink supply control unit 1113.

The ink consumption amount count value 1115 is a count value representing the number of ink droplets ejected from the head 201. The value 1115 is reset by the control unit 111 when ink is supplied to the ink buffer 203.

The buffer threshold value 1116 is a value representing a lower limit of an amount of ink stored in the ink buffer 203. The buffer threshold value 1116 is compared with the count value 1115.

The above-described control unit 111 performs a first operation and a second operation. The first operation includes the head waveform creating operation and the subsequent pass printing process. The second operation includes an ink supply operation using the pump 205, an ink detecting waveform creating operation, and an ink consumption state detecting operation. The control unit 111 performs the second operation while the first operation is performed.

With the above-described configuration, it is possible to detect the ink consumption state of the ink cartridge 202 while one pass printing process is performed. At the same time, it is possible to store ink required for the subsequent pass printing process before the subsequent pass printing process is started. Accordingly, since it is possible to shorten a time required for the printing process (for example, the printing process for one page) requiring the multi-pass printing process, it is possible to prevent problems where ink is exhausted during the printing process.

Figure 3A:
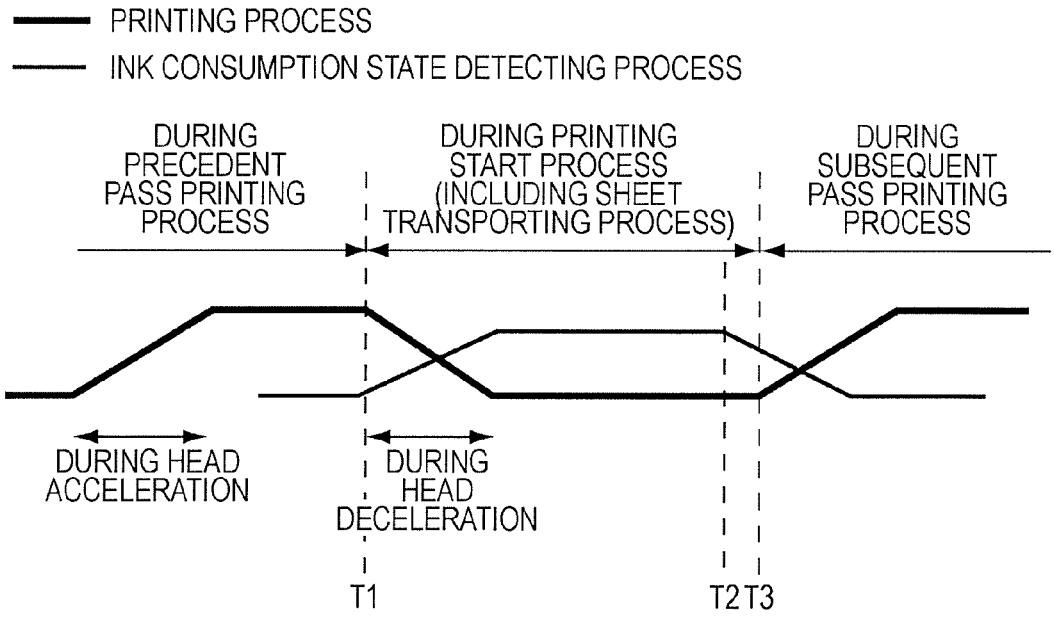
FIG. 3A is a diagram corresponding to FIG. 1B.
Figure 3B:
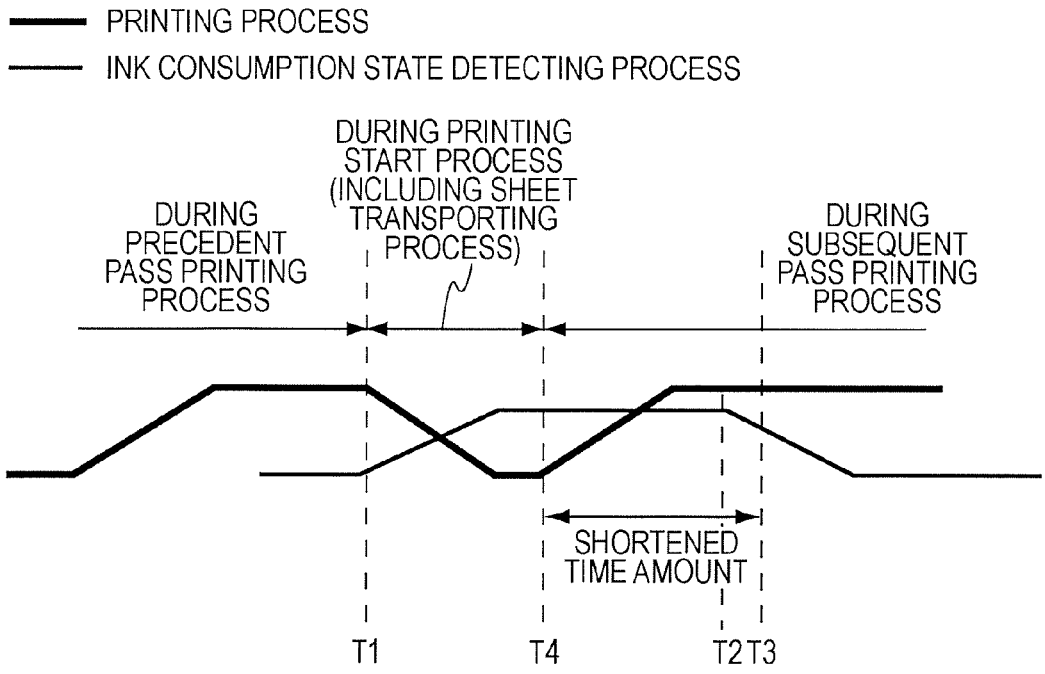
FIG. 3B illustrates a timing chart of a one pass printing process and the ink consumption state detection according to the embodiment of the invention.

On the basis of the comparison between FIGS. 3A and 3B arranged in the vertical line, it is understood that the time required for the printing process is shortened.

Figure 1B:
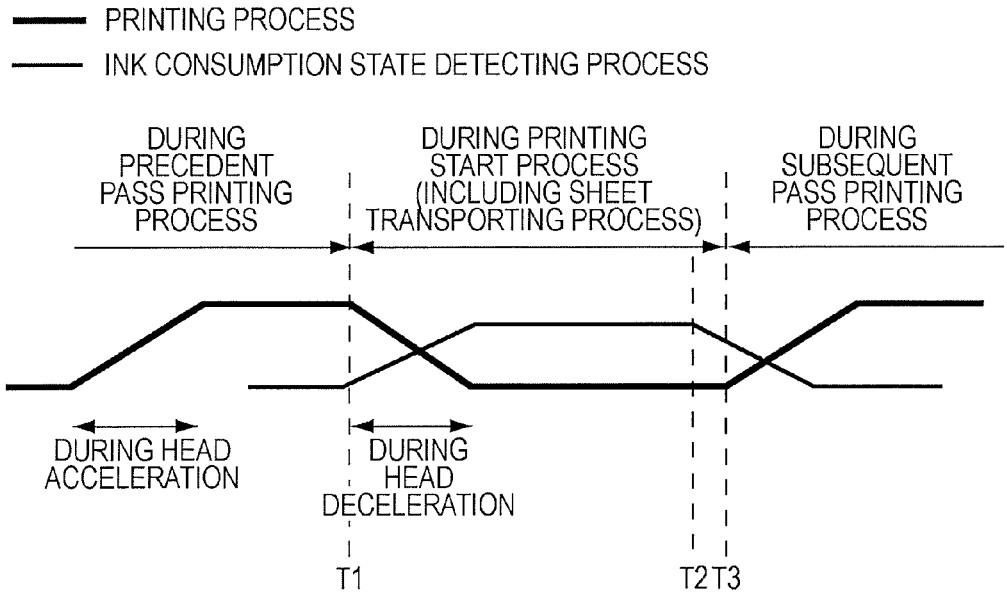
FIG. 1B illustrates a timing chart of a one pass printing process and the ink consumption state detection of the printer shown in FIG. 1A.

FIG. 3A is a diagram corresponding to FIG. 1B, and is a diagram illustrating the related art and prepared for the comparison with FIG. 3B. FIG. 3B illustrates a timing chart of one pass printing process and an ink consumption state detection according to the embodiment.

According to the comparison between FIGS. 3A and 3B, the subsequent pass printing process is started (at a time point T4) before the ink consumption state detection is completed (before a time point T2), and the ink consumption state detection is completed (at a time point T2) while the subsequent pass printing process is performed. For this reason, a time (the time during the printing start process) from the end of the precedent pass printing process to the start of the subsequent pass printing process is shortened from a time between the time points T1 and T3 shown in FIG. 3A to a time between the time points T1 and T4 shown in FIG. 3B. That is, the time during the printing start process is shortened by the time between the time points T4 and T3.

In addition, the ink supply to the ink buffer 203 for the subsequent pass printing process ends during the subsequent pass printing process. For this reason, it is possible to decrease the possibility that the ink becomes exhausted and thereby cause ink shortages in the subsequent pass printing process.

Figure 4:
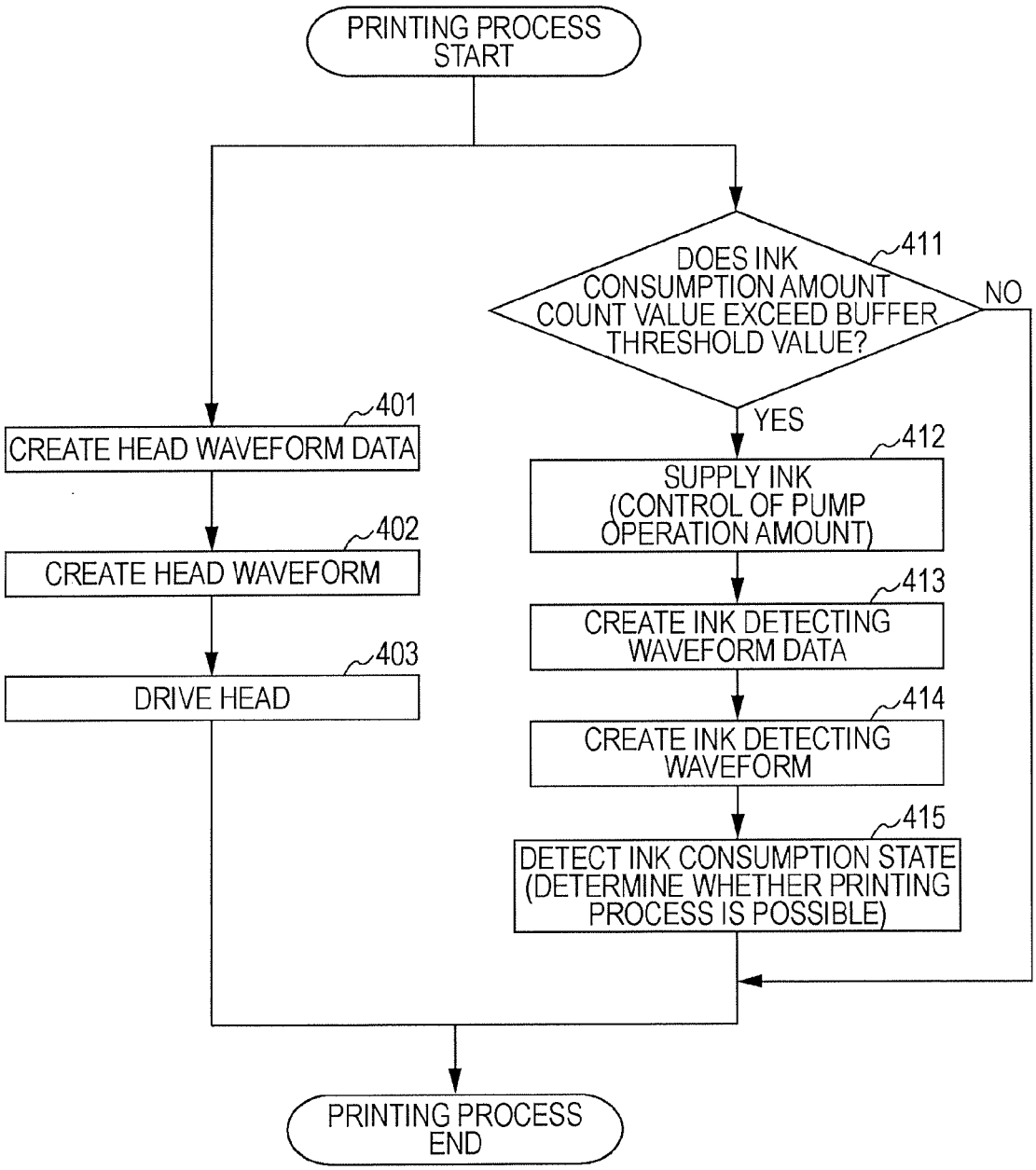
FIG. 4 illustrates a sequence of a printing process according to the embodiment of the invention.

FIG. 4 illustrates a sequence of the printing process according to the embodiment. The printing process is a process involved with one pass printing process.

As described above, the second operation is performed while the first operation is performed. Accordingly, the first operation and the second operation are simultaneously performed.

First, Step 401 to Step 403 according to the first operation will be described.

In Step 401, the printing process control unit 1114 creates head waveform data in the head waveform data creating unit 1111. The head waveform data creating unit 1111 outputs the data to the head waveform creating circuit 1121.

In Step 402, the head waveform creating circuit 1121 creates a head waveform on the basis of the head waveform data, and transmits the waveform to the head driving circuit 113.

In Step 403, the head driving circuit 113 drives the head 201 on the basis of the waveform.

Next, Step 411 to Step 415 according to the second operation will be described.

In Step 411, the printing process control unit 1114 determines whether the ink consumption amount count value 1115 exceeds the buffer threshold value 1116. When the ink consumption amount count value 1115 exceeds the buffer threshold value 1116, it is determined that a large amount of ink is consumed, and hence there is concern that it is not possible to guarantee the ink required for the subsequent pass printing process. For this reason, when the determination result is YES, Step 412 to Step 415 are performed. When the determination result is NO, Step 412 to Step 415 are skipped.

In Step 412, the printing process control unit 114 supplies ink to the ink buffer 203 by using the ink supply control unit 113. The ink supply control unit 113 supplies ink stored in the ink cartridge 202 to the ink buffer 203 by operating the pump 205. In addition, at this time, since the ink supply control unit 113 calculates an operation amount for operating the pump 205 before supplying ink using the pump 205, it is possible to operate the pump 205 in accordance with the calculated operation amount. For example, the ink supply control unit 113 calculates the difference between the ink consumption amount count value 1115 and the buffer threshold value 1116, and calculates the operation amount of the pump 205 on the basis of the calculated difference. The operation amount is small when the difference is small, and the operation amount is large when the difference is large.

In Step 413, the printing process control unit 1114 creates the ink detecting waveform data by using the ink detecting waveform data creating unit 1112. The ink detecting waveform data creating unit 1112 outputs the data to the ink detecting waveform creating circuit 1122.

In Step 414, the ink detecting waveform creating circuit 1122 creates an ink detecting waveform on the basis of the ink detecting waveform data, and transmits the waveform to the ink detecting circuit 114.

In Step 415, the ink detecting circuit 114 drives a piezoelectric element inside the ink cartridge 202 in accordance with the waveform, detects a resonance generated by the driving operation, and then detects the existence of the ink inside the ink cartridge 202 as the ink consumption state on the basis of the detection of the resonance. The ink detecting circuit 114 informs the control unit 111 of the ink consumption state detection result. The control unit 111 determines whether the subsequent pass printing process is possible during the ink consumption state detection on the basis of the ink consumption state detection result (since the ink required for the subsequent pass printing process is supplied in the second operation including the ink consumption state detecting operation, if ink remains in the ink cartridge 202 even after the supply operation is completed, it is possible to guarantee that the ink is not exhausted in the subsequent pass printing process). When the determination result is NO, the control unit 111 may perform a predetermined error process (for example, the printing process may be stopped at the timing after the current pass printing process is completed, and an error message may be output).

As described above, although the exemplary embodiment of the invention has been described, the embodiment is an example for the description of the invention, and the scope of the invention is not limited to the embodiment. The invention may be realized by other various embodiments. For example, the liquid ejecting apparatus is not limited to the ink jet printer, but may be a liquid ejecting apparatus for ejecting a liquid other than ink. That is, the liquid ejecting apparatus may be adopted which performs a recording process other than a printing process. Here, the "recording process" includes, for example, a case in which an interconnection pattern or a pixel is depicted by ejecting a liquid containing a material having a predetermined characteristic onto a circuit board as the printing target medium as well as the case of the printing process. For example, a liquid ejecting apparatus may be adopted which ejects a liquid obtained by dispersing or dissolving therein a material such as an electrode material or a color material used to manufacture a liquid crystal display, an EL (Electroluminescence) display, a plane emission display, and the like.

The entire disclosure of Japanese Patent Application No. 2009-090778, filed Apr. 3, 2009 is incorporated by reference herein.

What is claimed is:

1. A liquid ejecting apparatus comprising:

an ejecting unit which repeatedly ejects a liquid every predetermined unit;

a first storing unit which stores the liquid to be supplied to the ejecting unit;

a second storing unit which stores the liquid to be supplied to the first storing unit;

a pump which supplies the liquid from the second storing unit to the first storing unit;

a first creating unit which creates an ejection signal for ejecting the liquid in the ejecting unit;

a second creating unit which creates a detection signal for detecting the liquid of the second storing unit; and a control unit which performs a first operation and a second operation, wherein the first operation includes an operation of creating the ejection signal using the first creating unit and an operation of performing a predetermined unit of a subsequent ejection using the ejecting unit, and the second operation includes an operation of supplying the liquid using the pump, an operation of creating the detection signal using the second creating unit, and an operation of detecting the liquid of the second storing unit, and wherein the control unit performs the second operation while the first operation is performed.

2. The liquid ejecting apparatus according to claim 1, wherein the control unit determines whether a predetermined unit of ejection is possible subsequently after a predetermined unit of ejection performed during the detection of the liquid of the second storing unit on the basis of the detection result of the liquid of the second storing unit.

3. The liquid ejecting apparatus according to claim 1, wherein the detection of the liquid of the second storing unit in the second operation is to detect whether the remaining amount of the liquid of the second storing unit is equal to or greater than a predetermined amount on the basis of a reaction with respect to the supply of the detection signal.

4. The liquid ejecting apparatus according to claim 1, wherein the second storing unit has a liquid capacity in which at least one predetermined unit of liquid ejection is possible.

5. The liquid ejecting apparatus according to claim 1, wherein the second operation includes an operation of calculating an operation amount for operating the pump before supplying the liquid using the pump.

6. A liquid ejecting apparatus comprising:

an ejecting unit which repeatedly ejects a liquid every predetermined unit;

a first storing unit which stores the liquid to be supplied to the ejecting unit;

a liquid supply path which is connected to a second storing unit storing the liquid to be supplied to the first storing unit;

a pump which supplies the liquid from the second storing unit to the first storing unit;

a first creating unit which creates an ejection signal for ejecting the liquid in the ejecting unit;

a second creating unit which creates a detection signal for detecting the liquid of the second storing unit; and a control unit which performs a first operation and a second operation, wherein the first operation includes an operation of creating the ejection signal using the first creating unit and an operation of performing a predetermined unit of a subsequent ejection using the ejecting unit, and the second operation includes an operation of supplying the liquid using the pump, an operation of creating the detection signal using the second creating unit, and an operation of detecting the liquid of the second storing unit, and wherein the control unit performs the second operation while the first operation is performed.

* * * * *